US008796576B2

(12) United States Patent
Zimmermann

(10) Patent No.: US 8,796,576 B2
(45) Date of Patent: Aug. 5, 2014

(54) SORTING SYSTEM AND METHOD FOR FLAT ITEMS OF MAIL

(75) Inventor: Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 62 days.

(21) Appl. No.: 12/329,262

(22) Filed: Dec. 5, 2008

(65) Prior Publication Data

US 2009/0145819 A1 Jun. 11, 2009

(30) Foreign Application Priority Data

Dec. 5, 2007 (DE) ..... 10 2007 058 581

(51) Int. Cl.
*B07C 5/00* (2006.01)

(52) U.S. Cl.
USPC ..... 209/583; 700/224; 700/225

(58) Field of Classification Search
USPC ..... 209/569, 583, 584, 900; 700/223–226
See application file for complete search history.

(56) References Cited

U.S. PATENT DOCUMENTS

| | | | | | |
|---|---|---|---|---|---|
| 4,388,994 | A | * | 6/1983 | Suda et al. | 209/564 |
| 4,615,446 | A | | 10/1986 | Pavie | |
| 4,778,062 | A | | 10/1988 | Pavie et al. | |
| 5,119,954 | A | * | 6/1992 | Svyatsky et al. | 209/584 |
| 5,158,183 | A | * | 10/1992 | Beerman et al. | 209/546 |
| 5,277,321 | A | * | 1/1994 | Nagasawa et al. | 209/583 |
| 5,577,596 | A | | 11/1996 | Van Essen | |
| 5,901,855 | A | * | 5/1999 | Uno et al. | 209/584 |
| 5,908,116 | A | * | 6/1999 | Levaro et al. | 209/584 |
| 6,054,666 | A | * | 4/2000 | Yamashita et al. | 209/583 |
| 6,124,561 | A | | 9/2000 | Luckhurst et al. | |
| 2008/0000814 | A1 | | 1/2008 | Zimmermann | |
| 2008/0087582 | A1 | | 4/2008 | Zimmermann | |

FOREIGN PATENT DOCUMENTS

| | | | |
|---|---|---|---|
| DE | 2742802 | A1 | 4/1979 |
| DE | 2945386 | C2 | 6/1986 |
| DE | 10 2004 056 696 | B4 | 6/2006 |
| DE | 102006030096 | A1 | 1/2008 |
| EP | 1872866 | A2 | 1/2008 |
| WO | 2006056454 | A1 | 6/2006 |
| WO | 2006110486 | A2 | 10/2006 |

* cited by examiner

*Primary Examiner* — Joseph C Rodriguez
(74) *Attorney, Agent, or Firm* — Laurence A. Greenberg; Werner H. Stemer; Ralph E. Locher

(57) ABSTRACT

A sorting system for flat items of mail has $N_1 \geq 2$ parallel-connected groups of storage modules for simultaneously storing a multiplicity of items of mail. The items of mail are fed through $N_2 \geq 1$ parallel mail feeders to in each case a plurality of groups, and discharged via $N_3 \geq 2$ parallel mail dischargers from in each case a plurality of groups. A process controller controls a joint storing of items of mail from a stream of mail into storage modules belonging to at least one group and simultaneously controls discharging of jointly deposited items of mail from storage modules belonging to at least one other group. It is thus possible to intersperse the streams of mail with little or no intersecting, accompanied by a high throughput rate through the sorting system.

14 Claims, 5 Drawing Sheets

SORTING SYSTEM AND METHOD FOR FLAT ITEMS OF MAIL

CROSS-REFERENCE TO RELATED APPLICATION

This application claims the priority, under 35 U.S.C. §119, of German application DE 10 2007 058 581.2, filed Dec. 5, 2007; the prior application is herewith incorporated by reference in its entirety.

BACKGROUND OF THE INVENTION

Field of the Invention

The invention relates to a sorting system for flat items of mail that has $N_1 \geq 2$, in particular $N_1 \geq 3$, parallel-connected groups of storage modules for simultaneously storing a multiplicity of items of mail, $N_2 \geq 1$ parallel mail feeders to in each case a multiplicity of groups, and $N_3 \geq 2$ parallel mail dischargers from in each case a multiplicity of groups.

Flat items of mail such as standard-format and large-format letters, post-cards, sealed periodicals and the like are sorted according to their address in large quantities in mail centers or large post offices and, possibly after being pre-sorted, deposited in a multiplicity of stacking compartments. The degree of sorting fineness that can be achieved is determined by the number of sorting operations and the number within each sorting operation of stacking compartments among which the items of mail are distributed. A high throughput rate for the flat items of mail through the sorting apparatuses is desirable to be able to sort a large amount of items of mail in a short period of time. The throughput rate is dependent on the speed at which the items of mail are transported through the apparatus and on the distances between them. Neither parameter can be raised beyond a specific measure without considerable expenditure.

For further increasing the throughput rate it is known how to handle streams of mail in parallel. The items of mail are therein singularized by, for example, two feeders into two streams of mail that are processed in parallel by two segments of the sorting apparatus. Each segment is therein assigned an address range or, as the case may be, sorting range. The throughput rate can be doubled thereby. So that each item of mail from both streams can reach each stacking compartment of the two segments, pre-sorting is necessary which in keeping with their address distributes the items of mail in both streams between both segments of the sorting apparatus. The streams of mail are mutually interspersed in the case of said type of pre-sorting, with collisions being impermissible.

A system for the collision-free mutual interspersing of three streams of mail is described in my commonly assigned German patent DE 10 2004 056 696 B4 and its counterpart U.S. patent application US 2008/0087582. The streams are fed to an assemblage of interweaving transporting lines having a multiplicity of intersections so that each item of mail can be ducted to specific intersections at which a collision will be avoided. Some braking and accelerating modules are provided for the items of mail in the interwoven lines so that a small distance can be maintained between them.

SUMMARY OF THE INVENTION

It is accordingly an object of the invention to provide a sorting system for flat items of mail which overcomes the above-mentioned disadvantages of the heretofore-known devices and methods of this general type and which allows items to be pre-sorted at a high throughput rate onto two or more segments of a sorting apparatus.

With the foregoing and other objects in view there is provided, in accordance with the invention, a sorting system for flat items of mail, comprising:

a number $N_1 \geq 2$ of parallel-connected groups of storage modules for simultaneously storing a multiplicity of items of mail;

a number $N_2 \geq 1$ of parallel mail feeders each disposed to feed to a plurality of said groups of storage modules; and a number $N_3 \geq 2$ of parallel mail dischargers each disposed to discharge from a plurality of said groups of storage modules; and a process controller configured to control a joint storing of items of mail from a stream of mail into storage modules belonging to at least one group of storage modules, and to simultaneously control discharging of jointly deposited items of mail from storage modules of at least one other group of storage modules.

In other words, the objects of the invention are achieved by way of a sorting system of the type described above which, in accordance with the invention, includes a process controller for controlling a joint storing of items of mail from a stream of mail into storage modules belonging to at least one group, in particular into storage modules belonging to at least two groups, and simultaneously controlling discharging of jointly stored items of mail from storage modules belonging to at least one other group. What can be achieved is an interspersing of the streams of mail with little or no intersecting, accompanied by a high throughput rate through the sorting system.

All items of mail can initially be inserted in keeping with their target segment into a plurality of storage modules and jointly deposited there so they will hence then be stored there jointly. If one of the storage modules is full or there is a more favorable changeover instant owing to different parameters, then further depositing into the storage modules will be terminated and the items of mail will be discharged from the storage modules, expediently at high speed in order to produce a coherent stream of mail having a working speed and a pace which are that of the sorting system's succeeding segments. Each storage module is advantageously assigned only to a single segment of the sorting system and always completely or partially emptied only thereinto. Expediently no items of mail will be fed to the storage module during emptying. The items of mail will during that time be deposited into other storage modules from which preferably no items of mail will be removed during that time.

The sorting system can be part of a sorting apparatus having a plurality of segments that can each be fed with pre-sorted items of mail by one—expediently by only one—of the mail dischargers. The items of mail can be any type of mail whose length and breadth in each case substantially exceed their thickness, for example by a factor of at least 10. The groups expediently each contain a plurality of storage modules which are advantageously connected in the groups in each case mutually in parallel. The storage modules are designed for accommodating a multiplicity of items of mail, expediently at least 10, in particular at least 50, which can be stored in the storage module, in particular stacked one upon the other. What is understood by simultaneously depositing a multiplicity of items of mail is that said items are all present deposited or stored together in the storage module and not just stored each one after the other for a brief moment then unstored again before the next item of mail is deposited momentarily.

The mail feeders can each be connected to a singularizing means assigned only to it. They can have branches to all storage modules to which they are connected. The mail dischargers can be connected to in each case one segment of the sorting apparatus, in particular to only one single segment thereof, so that during an emptying operation they will be emptied up to complete emptying into only one segment, in particular always only into one segment. The mail dischargers are expediently at all places different from all mail feeders so that no transporting section for items of mail will simultaneously be a mail feeder to a storage module and a mail discharger from the storage module or from another storage module. The mail dischargers are advantageously connected to the mail feeders only via storage modules. The mail feeders and dischargers are transporting means having in each case the form of, for example, a single transporting line for transporting the items of mail respectively to and away from the storage modules. Feeder branches in the form of, for example, transporting lines between the mail feeders and dischargers and the storage modules can branch off from the mail feeders and dischargers to the storage modules. The mail dischargers are expediently connected to all groups for the purpose of transporting mail.

The process means can include one or more electronic data-processing units and is expediently provided and suitably prepared for controlling joint depositing of all items of mail contained in a stream thereof in particular from all mail feeders, into storage modules.

The items of mail can be present in the stream(s) of mail belonging to the mail feeder(s) in mixed form in terms of their destination mail discharger and can be sorted by the sorting system into the mail dischargers. Sorting can be done by dividing up the items of mail into each group's individual storage modules so that said items will be present within the groups already sorted. Each mail feeder is accordingly expediently connected to all storage modules belonging to at least one group for the purpose of transporting the items of mail so that said items can be appropriately sorted among the storage modules.

A stream of mail consists expediently of a multiplicity of items of mail, in particular more than 20 such items transported one after the other. The stream of mail can be a stream of equal thickness in which the items of mail are transported away one after the other with a gap between them within a pre-specified size range and in particular at equal speed.

In an advantageous embodiment variant of the invention the joint depositing of the items of mail is a non-unstoring storing and the discharging of jointly deposited items of mail is a non-storing unstoring. The items of mail can be deposited and discharged in a non-disruption-prone manner. What is understood by non-unstoring storing is that items of mail in the stream thereof are stored into a storage module, meaning that said items are deposited in the storage module without any items of mail from said stream being discharged again from the storage module during storing. Expediently no items of mail at all will be removed or unstored from the storage module while the stream of mail is being deposited into the storage module. What, conversely, is understood by non-storing unstoring is that no further items of mail will be deposited in the storage module, expediently not inserted into the storage module either, while a stream of mail is being unstored from a storage module, meaning while the items of mail in the stream thereof are being discharged from the storage module.

In a further advantageous embodiment variant of the invention the storage modules are last-in-first-out modules, meaning storage modules of a type from which the last stored item of mail from a multiplicity of such items will be unstored again, which is to say discharged from the storage module, first. Many items of mail can be stored and unstored quickly, reliably, and economically.

According to a preferred embodiment variant of the invention, all groups have the same number of storage modules, as a result of which all mail dischargers can be served evenly by in each case one storage module in each group. In particular the number of storage modules in each group is for that purpose the same as the number of mail dischargers.

Simple and non-fault-prone storing of items of mail on their way from a mail feeder to a mail discharger can be achieved if only one storage module is serially always—meaning throughout the sorting system—located between a mail feeder and a mail discharger.

Another embodiment variant of the invention provides for the storage modules to be connected to the mail feeders and mail dischargers in such a way that a passage is possible from each mail feeder to each mail discharger through two storage modules, possibly also through more storage modules, expediently arranged mutually parallel. Items of mail having any starting and destination point, which is to say from any mail feeder to any mail discharger, can therefore be stored while other items of mail having the same starting and destination point are unstored from the parallel storage module and transported to their destination.

The number of potentially fault-prone intersections of transporting lines can be kept small if a first group is connected to only one of the mail feeders, a second group to only one of the other mail feeders, and a third group to both mail feeders.

With the same advantage, one feeder branch to the third group is expediently arranged behind a feeder branch to the first group and another feeder branch to the third group is arranged in front of a feeder branch to the second group.

The sorting system can be of compact design if the third group is arranged spatially between the first and second group.

Pre-sorting of the items of mail into the storage modules can be done simply if each mail discharger is connected to at least one storage module in each group. Each mail discharger is therein advantageously connected to only one storage module in each group in order to keep the number of intersections small.

If each mail feeder is connected to all storage modules from at least two groups, then pre-sorting can be associated with storing of items of mail into one group and simultaneous unstoring from the other group.

The groups basically have as many storage modules as there are mail dischargers, as a result of which each mail discharger—and hence each apparatus segment—can be assigned one storage module per group. Other constellations are, though, also possible, for example further storage modules per group, so that the group can be assigned further functions. The number $N_1$ of groups is advantageously one greater than the number $N_2$ of parallel mail feeders so that each mail feeder can at any time be assigned one group for storing and another group can be used for unstoring. One group can furthermore be used for alternating occupancy from a plurality of mail feeders.

With the above and other objects in view there is also provided, in accordance with the invention, a method for sorting flat items of mail wherein said items are ducted via $N_2 \geq 1$ parallel mail feeders to $N_1 \geq 2$ parallel-connected groups of storage modules for simultaneously storing or buffering a multiplicity of items of mail and from there into $N_3 \geq 2$ parallel mail dischargers. It is proposed for items of mail from a stream of mail, in particular from all mail feeders, to be stored jointly in storage modules belonging to at least one group and for items of mail simultaneously to be discharged from storage modules from at least one other group. Items of mail can be pre-sorted at a high throughput rate and with low risk of collision.

All control steps that are necessary therefor, also for further described details of the invention, can be initiated by process means which will then have been prepared accordingly.

Items of mail in a stream of mail from a mail feeder are advantageously always inserted into at least two storage modules in parallel and deposited there, and items of mail from at least two further storage modules are discharged in parallel so that the mail dischargers can be occupied with an even stream of mail of high density.

In a further advantageous embodiment variant of the invention a stream of mail from a mail feeder is in a first period of time deposited in first storage modules belonging to one group and in an ensuing period of time a stream of mail from the mail feeder is deposited in second storage modules belonging to another group and items of mail are simultaneously discharged from the first storage modules. The storage modules can be alternately filled and emptied and a stream of mail of even density can be produced in a mail discharger.

Other features which are considered as characteristic for the invention are set forth in the appended claims.

Although the invention is illustrated and described herein as embodied in sorting system for flat items of mail, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 2:
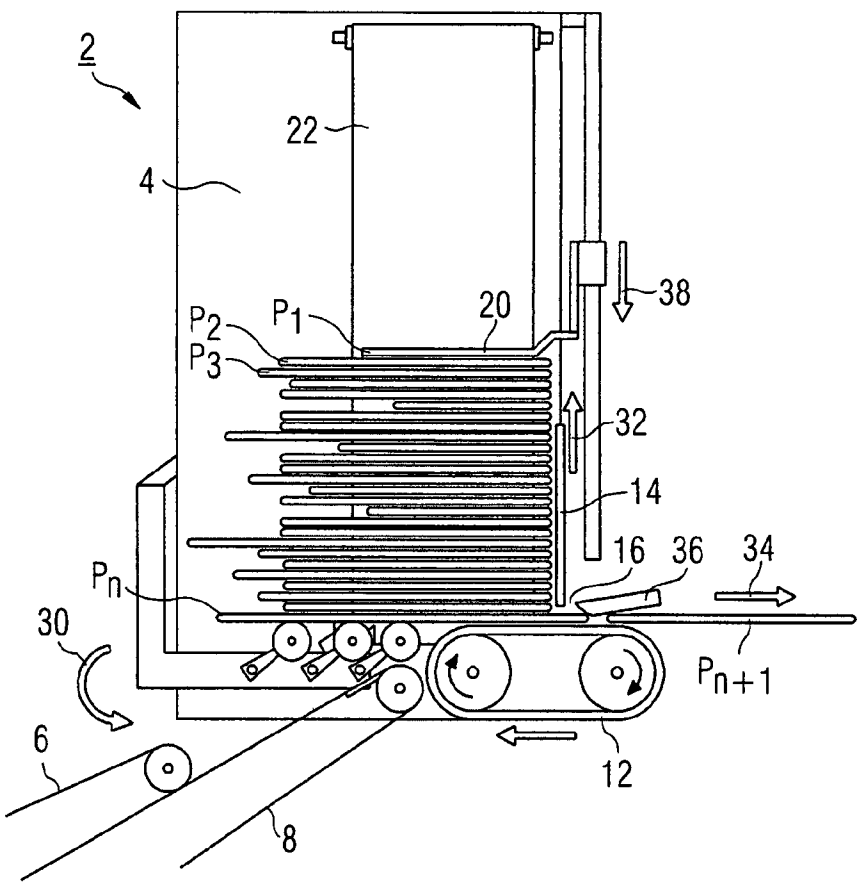
FIG. 2 is a top view onto the storage module shown in FIG. 1 performing a removing function.
Figure 1:
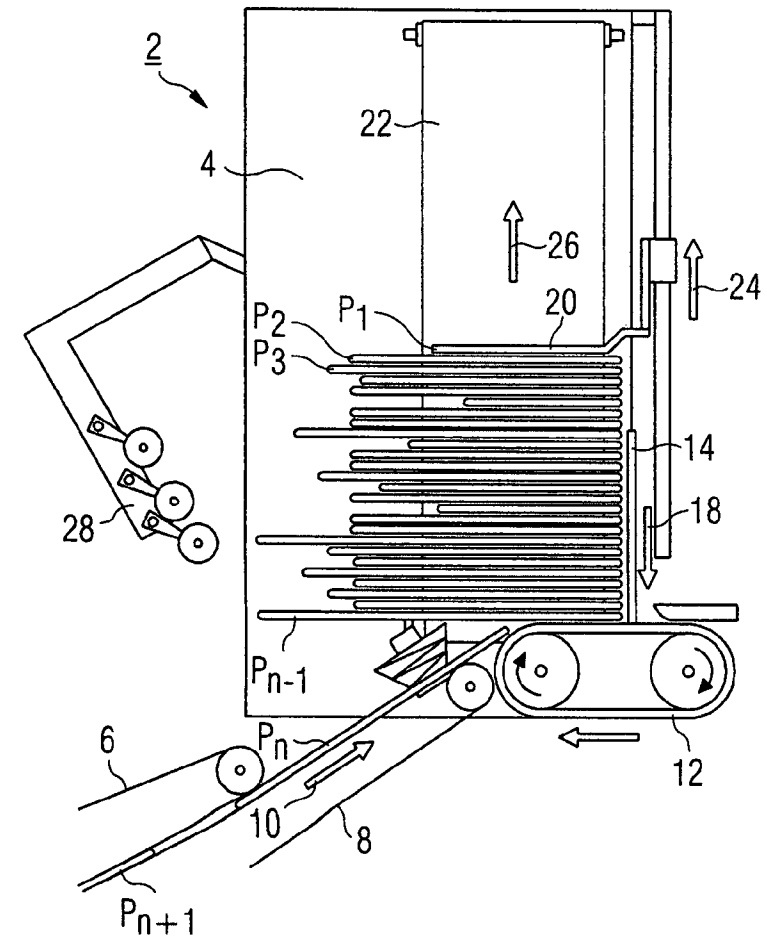
FIG. 1 is a top view onto a storage module performing an inserting function.

Referring now to the figures of the drawing in detail and first, particularly, to FIGS. 1 and 2 thereof, there is shown a schematic of a storage module 2, performing in FIG. 1 an inserting function and performing in FIG. 2 a removing function. The storage module 2 is a last-in-first-out (LIFO) module in the case of which the item of mail inserted last is removed first. It includes a storage area 4 in which items of mail $P_1, P_2, P_3, \ldots P_{n-1}$ are currently stored. The item of mail $P_n$ will in the representation shown be the next such item transferred into the storage area 4. Said item will be fed between two feeder belts 6, 8 to the storage module 2 in the conveying direction 10 and then taken over by a rolling belt 12. The rolling belt 12 is therein driven in a controlled manner and conveys the items of mail $P_1, P_2, \ldots P_{n-1}$ to a feed stop 14, as a result of which the items of mail $P_1, P_2, P_3, \ldots P_{n-1}$ will then be in a precisely defined position in the storage area 4 referred to their front and bottom edge. The feed stop 14 will in the position shown in FIG. 1 also block a removal opening 16 which—as indicated by an arrow 18—extends to immediately before the rolling belt 12.

For the items of mail $P_1, P_2, P_3, \ldots P_n$ it is of practical advantage if they are brought into contact with the rolling belt 12 under a certain feed pressure. For setting said feed pressure a separating blade 20 and an underfloor belt 22 are provided which, with the storage module 2 performing an inserting function, can in a very precisely controllable manner be moved as indicated by arrows 24, 26 in the stacking direction, meaning in the direction in which the stack is mounting in the storage area 4. By means of the separating blade 20 the feed pressure is produced on the roiling belt 12 antiparallel to the stacking direction.

The storage module 2 furthermore has a supporting-roller arrangement 28 which, with said module performing the inserting function shown in FIG. 1, has been swiveled into an inactive condition and can be swiveled in the swiveling direction 30 (FIG. 2) into its active condition.

In FIG. 2 the storage module 2 is shown performing its removing function. The supporting-roller arrangement 28 is in its swiveled-over, active condition and insures that the next item of mail $P_n$ requiring to be discharged is oriented in a plane that corresponds substantially to the plane spanned by the rolling belt 12 and in the immediate vicinity of the storage module 2 to the further conveying direction. With the removing function active, the feed stop 14 has been moved upwards as indicated by arrow 32 and thus releases the removal opening 16. The momentary view shown in FIG. 2 shows the item of mail $P_{n+1}$, which has already been completely removed and is being further conveyed in a removing direction 34, and the item of mail $P_n$, whose front edge is moving through the removal opening 16 and being kept in contact with the rolling belt 12 by a wiper 36. The wiper 36 helps avoid double removing because its friction coefficient is coordinated with the friction torque acting upon the rolling belt 12 and will in the event of double removing hold back the item of mail not in direct contact with the rolling belt 12. By means of the separating blade 20 a removing pressure is set that is indicated by the arrow 38.

So that the at least substantially vertical orientation of the items of mail stored in the storage area 4 can also be reliably insured when the storage module 2 is being continuously emptied, the underfloor belt 22 is driven as indicated by an arrow and, interacting with the pre-tensioned separating blade 20, thereby moves items of mail stored in the storage area 4.

Figure 3:
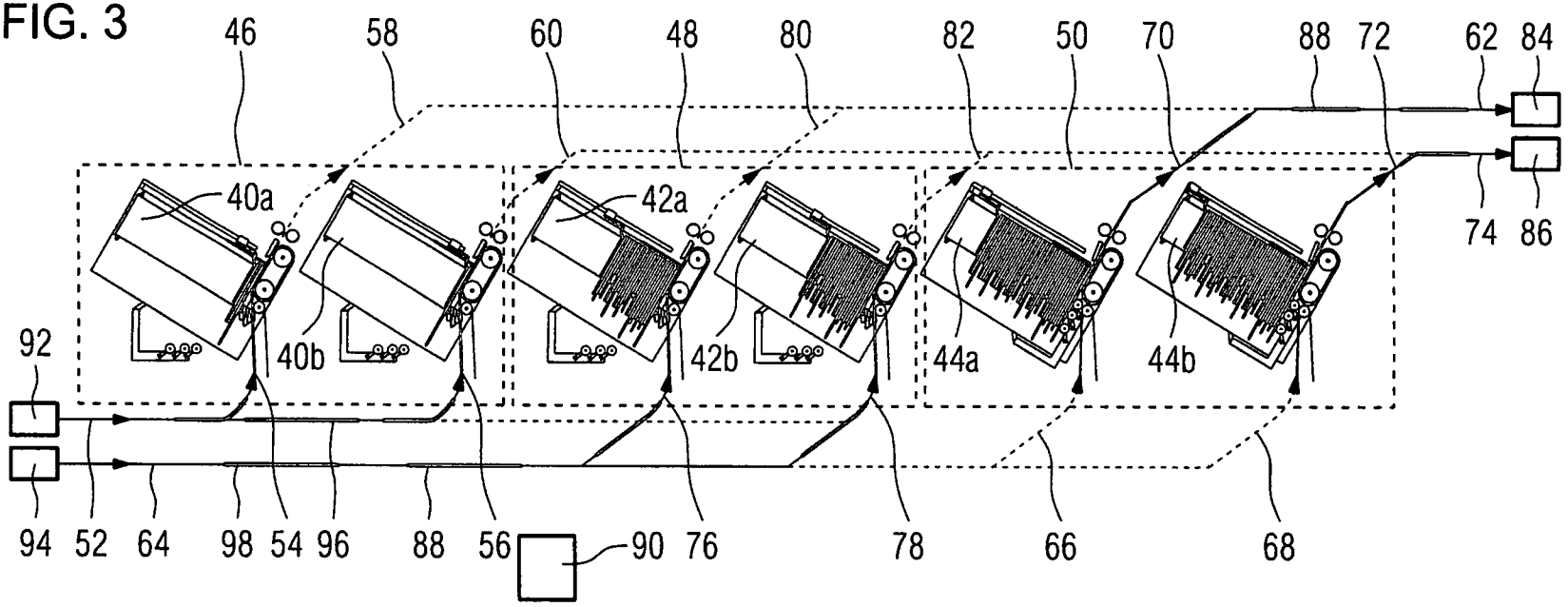
FIG. 3 shows a sorting system with three groups each having two storage modules from the two right-hand of which items of mail are discharged and into the other of which items of mail are deposited.

FIG. 3 shows six storage modules 40*a*, 40*b*, 42*a*, 42*b*, 44*a*, 44*b* as shown in FIGS. 1 and 2. Of the storage modules, modules 40*a*, 40*b* form a first group 46, the storage modules 42*a*, 42*b* form a second group 48, and the storage modules 44*a*, 44*b* form a third group 50. The storage modules 40*a*, 40*b* are connected to a mail feeder 52 via feeder branches 54, 56 and via further feeder branches 58, 60 respectively to a mail discharger 62 and mail discharger 74. The storage modules 44*a*, 44*b* are connected to a mail feeder 64 via feeder branches 66, 68 and via confluent feeder branches 70, 72 respectively to the mail discharger 62 and mail discharger 74. The storage modules 42*a*, 42*b* are each connected via branching feeder branches 76, 78 to both mail feeders 52, 64 and via confluent feeder branches 80, 82 respectively only to the mail discharger 62 and only to the mail discharger 74. The mail dischargers 62, 74 are in turn each connected to a segment 84, 86 of a mail-sorting apparatus so that items of mail 88 from the mail discharger 62 will be transported exclusively into the segment 84 and items of mail 88 from the mail discharger 74 exclusively into the segment 86.

A process controller or process means 90 in the form of a data-processing system is connected in signaling terms to all storage modules 40*a*-44*b* and to switches (not shown) that direct mail transporting from the mail feeders 52, 64 to the storage modules 40*a*-44*b* and from there to the mail dischargers 62, 74.

A multiplicity of items of mail 88 are during operation singularized by two singularizing means 92, 94 from in each case one batch and conveyed as streams of mail 96, 98 containing a multiplicity of items of mail 88 arranged evenly one behind the other into the mail feeders 52, 64. Mailing destinations of the items of mail 88, for example the addresses thereon, are read by means of two reading means (not shown). On the basis of the mailing destinations the process means 90 assigns the items of mail 88 to the segments 84, 86 or, as the case may be, the mail dischargers 62, 74 as the transportation destination for the items of mail 88.

Items of mail 88 that originate from the first mail feeder 52 and to which the first segment 84 was assigned as the transportation destination by the process means 90 are during a first time segment ducted to the storage module 40*a* and deposited there. Items of mail 88 that originate from the first mail feeder 52 and to which the second segment 86 was assigned as the transportation destination by the process means 90 are ducted to the storage module 40*b* and deposited there. Items of mail 88 that originate from the second mail feeder 64 and to which the first segment 84 was assigned as the transportation destination by the process means 90 are ducted to the storage module 44*a* and deposited there. And items of mail 88 that originate from the second mail feeder 64 and to which the second segment 86 was assigned as the transportation destination by the process means 90 are ducted to the storage module 44*b* and deposited there.

In that way the storage modules 40*a*, 40*b* and 44*a*, 44*b* are during the first period of time filled up with items of mail 88 in keeping with their statistical distribution according to mailing or, as the case may be, transportation destination and thickness. The fill level of the storage modules 40*a*, 40*b* and 44*a*, 44*b* can therein be monitored by the process means 90 with the aid of sensors on the storage modules 40*a*, 40*b* and 44*a*, 44*b*. It is also possible for the fill levels of the storage modules 40*a*, 40*b* and 44*a*, 44*b* to be estimated by the process means based on the number of items of mail 88 removed from the singularizing means 92, 94.

The first period of time ends and a second period of time begins at an instant at which the storage modules 40*a*, 40*b* have reached a pre-specified—measured or estimated—fill level, for example are half full. In said second period of time the items of mail 88 from the first mail feeder 52 are fed no longer to the storage modules 40*a*, 40*b* in the first group but to the storage modules 42*a*, 42*b* in the second group 48, divided according to their transportation destinations between the storage modules 42*a*, 42*b*. The storage modules 40*a*, 40*b* are simultaneously emptied through the items of mail 88 deposited therein being as described with reference to FIG. 2 singularized and fed to the mail dischargers 62 or, as the case may be, 74 for further transporting into the segment 84 or, as the case may be, 86.

One of the storage modules 44*a*, 44*b* will then at a further instant have been filled, as shown in FIG. 3, with the other of the storage modules 44*a*, 44*b* likewise having substantially been filled. The similarity in the fill levels of the two storage modules 44*a*, 44*b* depends on the distribution of the items of mail 88 according to their transportation destinations and on the capacity of the storage modules 44*a*, 44*b*. The greater their capacity is, the more similar will be their relative fill level according to the laws of statistics. It will therefore be advantageous if the storage modules 40*a*-44*b* are able to hold as many items of mail 88 as possible, for example a stack height of at least 500 mm.

The third operating mode starts at said further instant through storing of the items of mail 88 in the mail feeders 52, 64 into the storage modules 40*a*, 40*b*, 42*a*, 42*b* in the first two groups 46, 48 and simultaneous unstoring of the items of mail 88 from the storage modules 44*a*, 44*b* in the third group 50 into the mail dischargers 62, 74. That operating mode is shown in FIG. 3.

Figure 4:
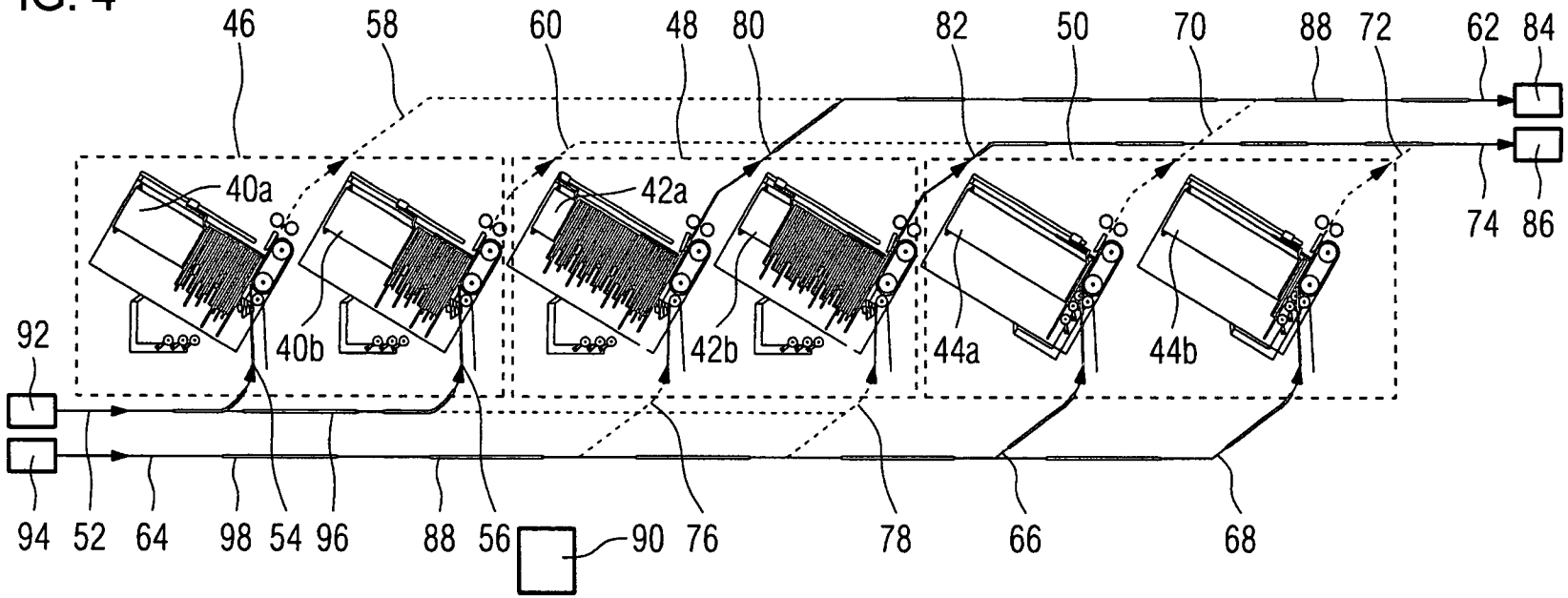
FIG. 4 shows the three groups shown in FIG. 2 from the middle two storage modules of which unstoring takes place and into the other of which storing takes place.

The storage modules 44*a*, 44*b* are emptied approximately twice as fast as the other storage modules 40*a*, 40*b*, 42*a*, 42*b* are filled so that the storage modules 44*a*, 44*b* will have been emptied when the storage modules 40*a*, 40*b* are approximately half full and the storage modules 42*a*, 42*b* are almost full. At the instant at which the storage modules 44*a*, 44*b* have been emptied, the process means 90 switches to the next operating mode during which the items of mail 88 are stored into the first group 46 and third group 50 and the initially still full second group 48 is emptied. That operating mode is shown in FIG. 4.

Figure 5:
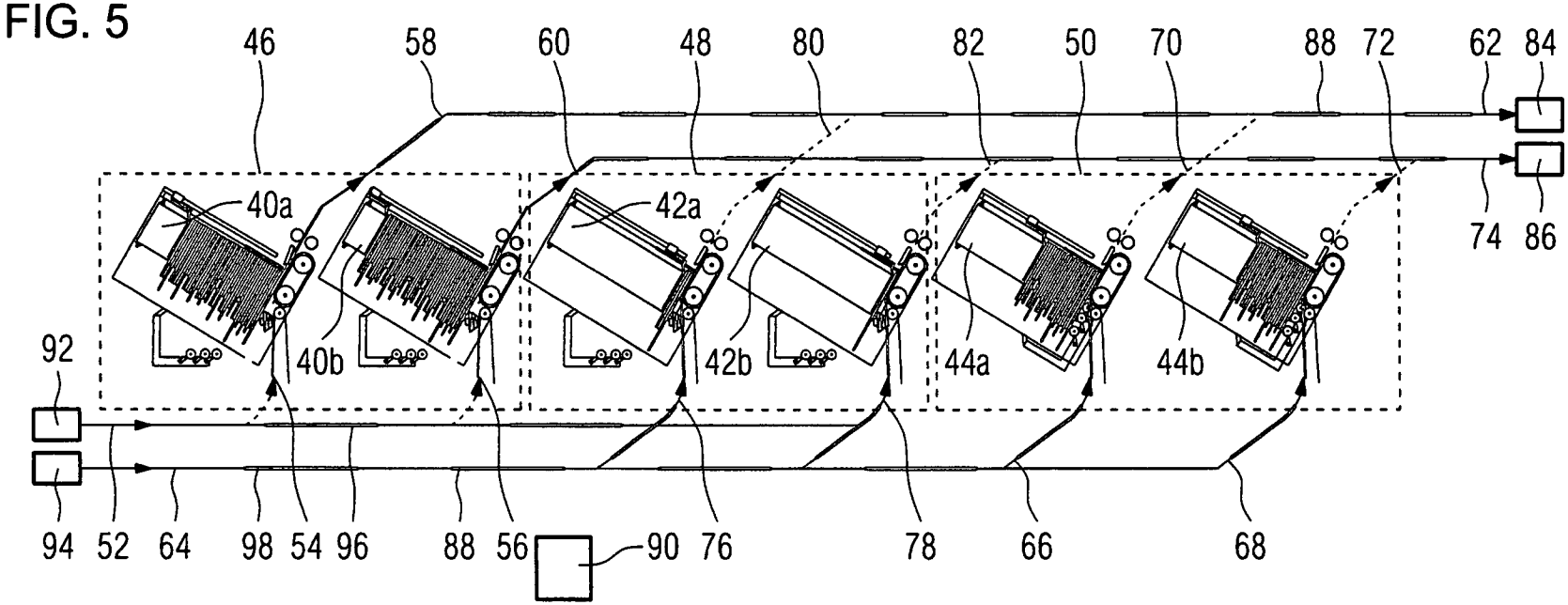
FIG. 5 shows the three groups shown in FIG. 2 from the two left-hand storage modules of which unstoring takes place and into the other of which storing takes place.

If at a next instant the storage modules 42*a*, 42*b* in the second group 48 have been emptied, the process means 90 will switch to the operating mode next in turn, during which storing takes place into the groups 48 and 50 and unstoring takes place from the then full group 46, as shown in FIG. 5.

Changing between three different operating modes in that way takes place in the ensuing, with the changeover instants being made dependent on the fill levels of the storage modules 40*a*-44*b*, in particular on the instant at which the storage modules 40*a*-44*b* in the process of being emptied have been completely emptied. The changeover instant can alternatively, additionally, and in particular in a higher command hierarchy be determined by a fill level of the specific storage modules 40*a*-44*b* into which storing is currently taking place. If, for example, one of them has been completely filled then changeover of the operating modes will be initiated even if one or both of the storage modules 40*a*-44*b* requiring to be emptied has/have not yet been completely emptied.

The feeder branches 76, 80 intersect respectively with the mail feeder 52 and mail discharger 74 and the feeder branches 70, 72, 78, 80, 82 form confluences with the mail feeders and dischargers 52, 64, 62, 74. A collision of items of mail 88 at those intersections and confluences can, though, be reliably avoided because in each case only one of the intersecting or discharging transportation paths is ever used in the above-described sorting process regardless of the changeover instant. Feeding of items of mail 88 to an intersection or confluence from two directions does not have to take place.

The storage modules 40*a*-44*b* are switched over in pairs from stacking mode to singularizing mode, and vice versa. The changeover instants can be determined by the process means 90 as a function of the as even as possible flow of mail into the mail dischargers 62, 74 and of the current fill levels of the storage modules 40*a*-44*b*.

Items of mail 88 present unsorted in two mail feeders 52, 64 are in the case of the exemplary embodiment shown in FIGS. 3-5 sorted into two mail dischargers 62, 74. It is thereby not only possible to provide pre-sorting at a high throughput rate but also to achieve an even flow of mail into the two segments 84, 86 substantially independently of the distribution of the items of mail 88 in the mail feeders 52, 64 according to their mailing or, as the case may be, transportation destination.

Figure 6:
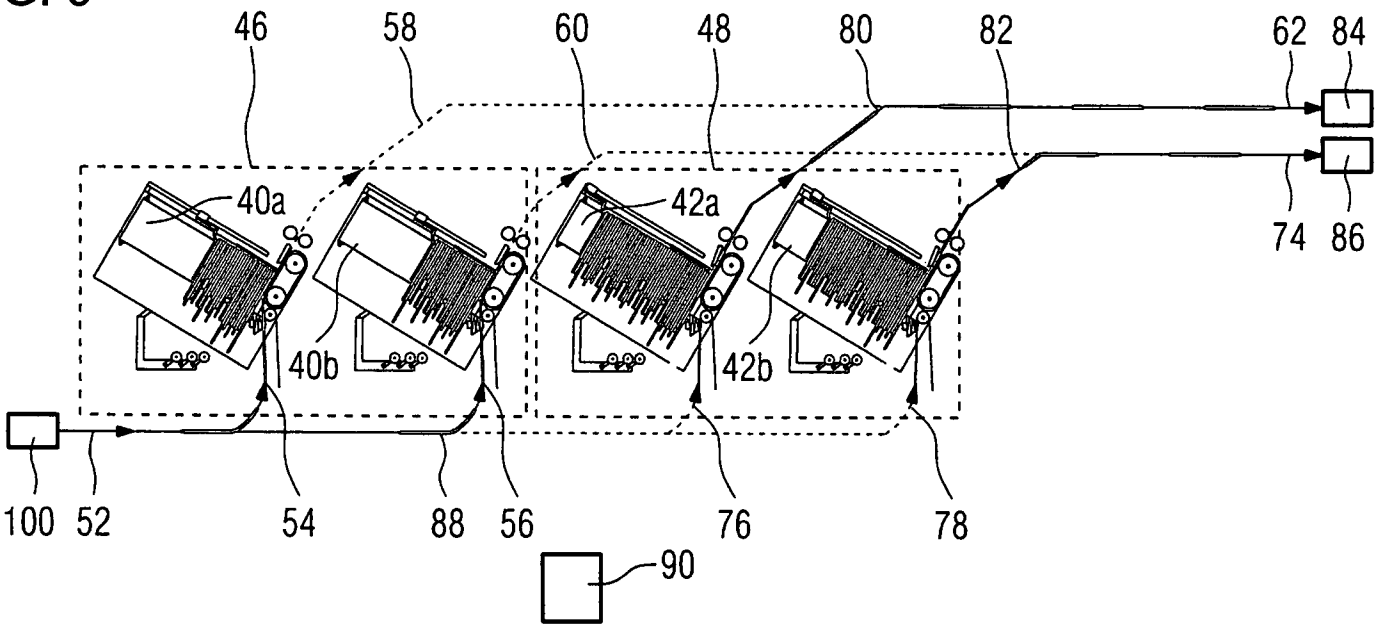
FIG. 6 shows another sorting system with two groups each having two storage modules.

Those advantages can be achieved in other configurations also. An example of another configuration is illustrated in FIG. 6 showing a different sorting system having two mail dischargers 62, 74 but only one mail feeder 52. The sorting system accordingly includes only two groups 46, 48 of storage modules 40*a*, 40*b* and 42*a*, 42*b* into the first group 46, 48 of which storing takes place in two alternating operating modes and from the second group 46, 48 of which unstoring simultaneously takes place, and vice versa. For that configuration it is advantageous for the mail feeder 52 to permit the same density of mail per time as both mail dischargers 62, 74 together, meaning that the items of mail 88 in the mail feeder 52 are transported, for example, twice as fast as in the mail dischargers 62, 74. It is for that purpose possible to combine a highly efficient singularizing means 100 with the segments 84, 86 or a customary singularizing means 92 with two economical and slow segments. Further details relating to that embodiment variant correspond to the details described in connection with the exemplary embodiment shown in FIGS. 3-5.

Further configurations are also advantageous. The number of storage modules in each group basically corresponds to the number of mail dischargers, with one storage module in each group being connected to each mail discharger. And the number of groups is basically the same as the number of mail feeders plus 1. The connections of the mail feeders and dischargers via feeder branches can be selected as being the same in all exemplary embodiments as described with reference to FIGS. 3 to 5. Other connections are of course also possible.

For example it is possible to combine two mail feeders with three mail dischargers, with there being for that purpose three groups each containing three storage modules. In each operating mode storing takes place into the storage modules of two groups and unstoring from the third groups' storage modules.

A configuration is furthermore conceivable in which three mail feeders are connected to two mail dischargers, namely by four groups each containing two storage modules. In the operating modes, storing takes place into three groups while unstoring takes place from the remaining group's storage modules, although in that example at three times the storing speed.

The invention claimed is:

1. A sorting system for flat items of mail, comprising:

a number $N_1 \geq 2$ of parallel-connected groups of storage modules for simultaneously storing a multiplicity of items of mail;

a number $N_2 \geq 1$ of parallel mail feeders each disposed to feed to a plurality of said groups of storage modules; and a number $N_3 \geq 2$ of parallel mail dischargers each disposed to discharge from a plurality of said groups of storage modules, a number of said storage modules in each group being equal to a number of said mail dischargers;

a process controller configured to jointly store items of mail from a stream of mail in storage modules belonging to at least one group of storage modules and jointly discharge deposited items of mail from storage modules of at least one other group of storage modules simultaneous to the store items of mail from the stream of mail in storage modules belonging to the at least one group of storage modules.

2. The sorting system according to claim 1, wherein the said process controller is configured to jointly store the items of mail while no discharge is taking place from the given storage module and to discharge the jointly deposited items of mail while no storing of items of mail is taking place in the given storage module.

3. The sorting system according to claim 1, wherein all of said groups of storage modules have an equal number of storage modules.

4. The sorting system according to claim 1, wherein only a single said storage module is respectively disposed in series between a mail feeder and a mail discharger.

5. The sorting system according to claim 1, wherein said storage modules are connected to said mail feeders and to said mail dischargers to enable a passage from each mail feeder to each mail discharger through two storage modules.

6. The sorting system according to claim 1, wherein a first group of storage modules is connected to only one of said mail feeders, a second group of storage modules is connected to only one of the other said mail feeders, and a third group of storage modules is connected to both said mail feeders.

7. The sorting system according to claim 6, wherein one feeder branch to said third group is arranged behind a feeder branch to said first group and another feeder branch to said third group is arranged in front of a feeder branch to said second group.

8. The sorting system according to claim 6, wherein said third group is arranged spatially between said first group and said second group.

9. The sorting system according to claim 1, wherein each said mail discharger is connected to at least one storage module in each group of storage modules.

10. The sorting system according to claim 1, wherein each said mail discharger is connected to only one storage module in each group of storage modules.

11. The sorting system according to claim 1, wherein each said mail feeder is connected to all storage modules from at least two groups of storage modules.

12. A method of sorting flat items of mail, which comprises the following method steps:

guiding the items of mail via $N_2 \geq 1$ parallel mail feeders to $N_1 \geq 2$ parallel-connected groups of storage modules for simultaneously storing or buffering a multiplicity of the items of mail;

guiding the items of mail from the storage modules into $N_3 \geq 2$ parallel mail dischargers;

providing a number of the storage modules in each group being equal to a number of mail dischargers; and jointly storing items of mail from a stream of mail in storage modules belonging to at least one group and discharging items of mail from storage modules of at least one other group simultaneously to the storing of item of mail in storage modules belonging to said at least one group.

13. The method according to claim 12, which comprises:

within a first period of time, depositing a stream of mail from a mail feeder in first storage modules belonging to one group; and within an ensuing period of time, depositing a stream of mail from the mail feeder in second storage modules belonging to another group and simultaneously discharging items of mail from the first storage modules.

14. A sorting system for flat items of mail, comprising:

a number $N_1 \geq 2$ of parallel-connected groups of storage modules, each of said storage modules for simultaneously storing a multiplicity of items of mail, said storage modules being last-in-first-out modules;

a number $N_2 \geq 1$ of parallel mail feeders each disposed to feed to a plurality of said groups of storage modules; and a number $N_3 \geq 2$ of parallel mail dischargers each disposed to discharge from a plurality of said groups of storage modules, a number of said storage modules in each group being equal to a number of said mail dischargers;

a process controller configured to jointly store items of mail from a stream of mail in storage modules belonging to at least one group of storage modules and jointly discharge deposited items of mail from storage modules of at least one other group of storage modules simultaneous to the store items of mail from the stream of mail in storage modules belonging to the at least one group of storage modules.

* * * * *